US008220666B2

(12) United States Patent
Abe

(10) Patent No.: US 8,220,666 B2
(45) Date of Patent: Jul. 17, 2012

(54) APPARATUS FOR EXTRACTING THE CONTENTS FROM A REFILL POUCH

(75) Inventor: Masayuki Abe, Tokyo (JP)

(73) Assignee: Kabushiki Kaisha Sanki (JP)

( * ) Notice: Subject to any disclaimer, the term of this patent is extended or adjusted under 35 U.S.C. 154(b) by 926 days.

(21) Appl. No.: 12/231,262

(22) Filed: Aug. 28, 2008

(65) Prior Publication Data

US 2009/0071977 A1 Mar. 19, 2009

(30) Foreign Application Priority Data

Sep. 19, 2007 (JP) ..... 2007-242320
Feb. 12, 2008 (JP) ..... 2008-030768
Jun. 16, 2008 (JP) ..... 2008-156440

(51) Int. Cl.
*B67D 7/06* (2010.01)

(52) U.S. Cl. ..... 222/181.2; 222/207; 222/213; 222/496

(58) Field of Classification Search ..... 222/181.2, 222/207, 213, 493, 496
See application file for complete search history.

(56) References Cited

U.S. PATENT DOCUMENTS 1,911,284 A * 5/1933 Nichols ..... 222/496
2,114,482 A * 4/1938 Vrtel ..... 222/496
2,554,570 A * 5/1951 Harvey ..... 222/207
2,572,167 A * 10/1951 Lowe, Jr ..... 222/322
4,249,675 A * 2/1981 Nilson ..... 222/207
4,515,294 A * 5/1985 Udall ..... 222/105
4,573,612 A * 3/1986 Maddison et al. ..... 222/105
4,705,195 A * 11/1987 Heck ..... 222/207
4,828,150 A * 5/1989 Bottger et al. ..... 222/207
4,946,075 A * 8/1990 Lundback ..... 222/181.3
5,601,212 A * 2/1997 Lee ..... 222/205
5,730,327 A * 3/1998 Stern ..... 222/82
6,971,553 B2 * 12/2005 Brennan et al. ..... 222/207

FOREIGN PATENT DOCUMENTS

JP 47039233 11/1972
JP 2000142851 5/2000
JP 2002104546 4/2002

* cited by examiner

*Primary Examiner* — Kevin P Shaver
*Assistant Examiner* — Daniel R Shearer
(74) *Attorney, Agent, or Firm* — Adams & Wilks

(57) ABSTRACT

An apparatus for extracting the contents from a refill pouch comprises a holding member for holding the pouch with its extraction port facing downward, and a pump attached to the extraction port of the pouch. The pump has a pump body defining a housing space having an inlet opening and an outlet opening, an inlet-side valve which communicates with the extraction port to open and close the inlet opening so that the contents can be introduced into the housing space from the pouch, and an outlet-side valve to open and close the outlet opening so that the contents in the housing space can be discharged through a nozzle that communicates with the outlet-side valve. The pump wall portion is constituted by a resiliently compressible, restorable and flexible material so that the contents in the housing space can be extracted through the nozzle by manually squeezing the pump wall portion thereby pressurizing the housing space.

2 Claims, 13 Drawing Sheets

APPARATUS FOR EXTRACTING THE CONTENTS FROM A REFILL POUCH

BACKGROUND OF THE INVENTION (1) Field of the Invention

The present invention relates to an apparatus for extracting the contents from a refill pouch, and more particularly to an apparatus by which pouch contents having fluidity, such as shampoo liquid, can easily be extracted from refill pouches, such as a shampoo liquid package, a rinse package, a detergent package and the like for refilling a dispenser or other container.

(2) Description of the Related Art

Refill pouches, such as a shampoo liquid package for refilling a container, are typically provided with either an extraction port having a tearable spout or a discharge tap stopped with a screw cap. Usually, after opening the extraction port, the contents in the package are dispensed to a container, for example, a shampoo container, for later use.

JP-A-2000-142851 describes an apparatus by which the contents can be directly extracted from a refill package and used without dispensing them to, for example, a shampoo container. The apparatuses of this type are usually constituted by supporting a refill pouch in a container or by a supporting member in an upright style, inserting a suction tube of a pump into an extraction port formed at an upper part of the pouch, actuating an operation button of the pump up and down to pump up the contents from the pouch, and discharging the contents through a nozzle of the pump. Using such apparatuses, it is difficult to completely extract the shampoo liquid, etc. from the pouch. In addition, since the pressing force when actuating the operation button is transmitted to a floor on which the container is placed or a wall on which the supporting member is mounted, it is necessary to firmly secure it on the wall, etc. In addition, if the container falls or the supporting member becomes detached from the wall by the pressing force, there is a likelihood that the contents may spill out from the extraction port, or air or water may enter the package through the extraction port and denature the contents, or the initial fragrance of the contents may become contaminated or degraded.

JP-A-2002-104546 describes an apparatus for hanging a pouch and extracting the contents through the bottom of the pouch. However, the apparatus of this type also has similar drawbacks since the pressing force for discharging the contents is borne by a wall surface, etc. when the button of the pump is pushed down and when the bottom of the pouch is cut and a pump is attached thereto.

Further, as described in Japanese Examined Utility Model Publication No. 47-39233, a pump for extracting the contents of a container is constructed so that the contents contained in a housing space of the pump are pressurized by a pressing operation and extracted through a nozzle, and by the suction created at the time of restoration, the contents in the container are sucked into the housing space through an inlet-side valve. The pump is attached to a wall surface and constructed so that when an operation button is pressed down, a valve at the inlet side is closed and a valve at the outlet side is opened, and when the operation button returns to its original position, the valve at the inlet side is opened and the valve at the outlet side is closed. Such a sequential operation is carried out by increasing or decreasing the pressure of the housing space which houses the contents. However, since the housing space is small and the force pressurizing the contents is weak, there are drawbacks that when the contents are extracted, the valve at the inlet side cannot completely be closed, and due to a time difference until the valve is closed, the contents may return into the pouch through the inlet, whereby it is difficult to sufficiently discharge the contents from the outlet side. Further, if not used for a long period of time, the contents, such as shampoo liquid, may solidify at the valve portion on the outlet side and clog the outlet opening.

SUMMARY OF THE INVENTION

It is an object of the present invention to provide an apparatus for extracting the contents from a refill pouch, in which the contents can be extracted by utilizing an extraction port normally formed on the pouch, whereby the contents can be completely and securely extracted without denaturing the contents or spilling the contents.

It is another object of the present invention to provide an apparatus for extracting the contents from a refill pouch, wherein the apparatus is durable in construction and reliable in operation.

Another object of the present invention is to provide an apparatus for extracting the contents from a refill pouch, in which the apparatus has a pump that can be manually actuated in a sidewise direction to extract the pouch contents.

According to one aspect of the present invention, an apparatus for extracting the contents from a refill pouch comprises a holding member for holding a refill pouch with its extraction port located downward, and a pump attached to the extraction port of the pouch. The pump has a pump body defining a substantially cylindrical housing space having an inlet opening and an outlet opening, an inlet-side valve which communicates with the extraction port and acts to open and close the inlet opening so that the contents can be introduced into the housing space from the pouch, and an outlet-side valve which acts to open and close the outlet opening so that the contents in the housing space can be discharged through a nozzle that communicates with the outlet-side valve. Two spindles are disposed in laterally spaced-apart relation at opposite ends of the pump body and are manually movable towards each other in the axial direction of the pump body to pressurize the housing space so that the contents can be extracted through the outlet-side valve.

In the apparatus for extracting the contents from a refill pouch having the above structure, the inlet-side valve may be a ball valve having a ball on the housing space side, the outlet-side valve may be a ball valve having a ball at the outside of the housing space, and one of the spindles may be provided with a slanted face to press the ball of the inlet-side valve so that when the spindles move axially towards each other, the slanted face presses the ball upwardly in close contact with the inlet opening to close the inlet-side valve.

According to another aspect of the present invention, an apparatus for extracting the contents from a refill pouch comprises a holding member for holding a refill pouch with its extraction port located downward, and a pump attached to the extraction port of the pouch. The pump has a pump body defining a housing space having an inlet opening and an outlet opening, an inlet-side valve which communicates with the extraction port and acts to open and close the inlet opening so that the contents can be introduced into the housing space from the pouch, an outlet-side valve which acts to open and close the outlet opening so that the contents in the housing space can be discharged, a nozzle that communicates with the outlet-side valve, and a pump wall portion constituted by a resiliently compressible, restorable and flexible material so that the contents can be extracted through the nozzle by manually squeezing the pump wall portion thereby pressurizing the housing space.

According to a further aspect of the present invention, the apparatus for extracting the contents from a refill pouch further comprises an insertion-securing device attached to the extraction port of the pouch. The insertion-securing device comprises an insertion cylinder having a contact member which is inserted into the extraction port and which has an elastic outer face, an engaging section made of a metal material, and a clamp section disposed in such a manner that it can be contacted under pressure with the insertion cylinder so that when the insertion cylinder is inserted into the extraction port, the pouch body is contacted under pressure with the engaging section and the opening of the pouch is covered by the contact member. The holding member for holding the pouch may be a gripping device for directly gripping a part of the pouch, or may be a holding member having a housing case in which the pouch is placed and which may be hung from a wall or other surface.

The apparatus of the present invention is constructed as mentioned above and comprises a holding member for holding a refill pouch with its extraction port located downward, and a pump attached to the extraction port of the pouch. In one embodiment, the pump has a pump body that defines a substantially cylindrical housing space, and at both ends of the pump body, spindles are slidably disposed so as to be movable towards one another in the axial direction of the pump body to pressurize the housing space. In another embodiment, the wall portion of the pump body is formed of resiliently compressible, restorable and flexible material, by which the pump body can be manually squeezed to pressurize the housing space. In both embodiments, the pouch contents can be extracted through a nozzle by pressurizing the housing space sidewise from both sides. Accordingly, the extraction port usually formed on the conventional pouches can be utilized as is without cutting the bottom of the pouch, and there is no risk of spilling or denaturation of the contents, or dissipation of fragrance. Further, by grasping the spindles on both sides of the pump to move them closer to each other, or by grasping the pump wall portion made of flexible material, the pouch contents can easily be extracted, and the contents in the pouch can be completely extracted by vacuum suction. Further, the load applied to the pump at the time of operation is not directly placed on the holding member and there is no risk of falling of the pouch.

Further, one of the spindles is provided with a slanted face at its front end portion so that when the two spindles are moved towards one another to close the inlet-side valve, the slanted face presses the ball in close contact with the inlet opening, and therefore when the spindles are operated, the ball is directly moved to immediately shut the inlet opening so that the contents will not return to the inside of the pouch. Accordingly, the outlet-side valve at the outlet opening can be securely opened and the contents can be immediately extracted. If the pump wall portion is made of a resilient, flexible material, the outlet-side valve can easily be opened only by grasping and squeezing the pump body, and therefore the contents can easily be extracted. Further, if a knob is provided on an axial valve stem of a valve element that is in close contact with a valve seat of the outlet-side valve, even when the pouch contents, such as shampoo liquid, solidify within the outlet-side valve to clog the valve, the contents can be dislodged and removed by pulling the knob and forcedly opening the valve.

As mentioned above, as the usual extraction port provided on the pouch, a discharge tap to which a cap is threadedly attached, and a protruded spout having a cutting line at which the spout can be cut and removed, have been known. In the case of using the cap, a joint cap having a similar thread portion may be provided at the pump body and the pump can be threadedly connected to the discharge tap using the joint cap. In the case of using the protruded spout, an insertion-securing device may be inserted into the cutaway spout, and a screw cap having a thread portion can be threadedly fixed to the insertion-securing device and then the pump can be threadedly connected to the screw cap, thereby eliminating risk of leakage of the pouch contents. When a closing member having elasticity and an engaging section made of a metal material are provided on the insertion cylinder of the insertion-securing device, and the pouch body is attached under pressure by a clamp section, even a relatively heavy pouch for shampoo liquid, etc. can be securely held without falling, and leakage can be certainly prevented.

BRIEF DESCRIPTION OF THE DRAWINGS

FIGS. 11A to 11C show an insertion cylinder of the insertion-securing device, wherein FIG. 11A is a plane view, FIG. 11B is a side view and FIG. 11C is a partially cutaway front view.

FIGS. 12A and 12B show an engaging section of the insertion-securing device, wherein FIG. 12A is a plane view and FIG. 12B is a cross-sectional view.

FIGS. 13A to 13C show a clamp section of the insertion-securing device, wherein FIG. 13A is a plane view, FIG. 13B is a front view and FIG. 13C is a side view.

FIGS. 14A to 14C show a lever of the insertion-securing device, wherein FIG. 14A is a plane view, FIG. 14B is a partially cutaway front view and FIG. 14C is a side view.

DETAILED DESCRIPTION OF THE INVENTION

Figure 1:
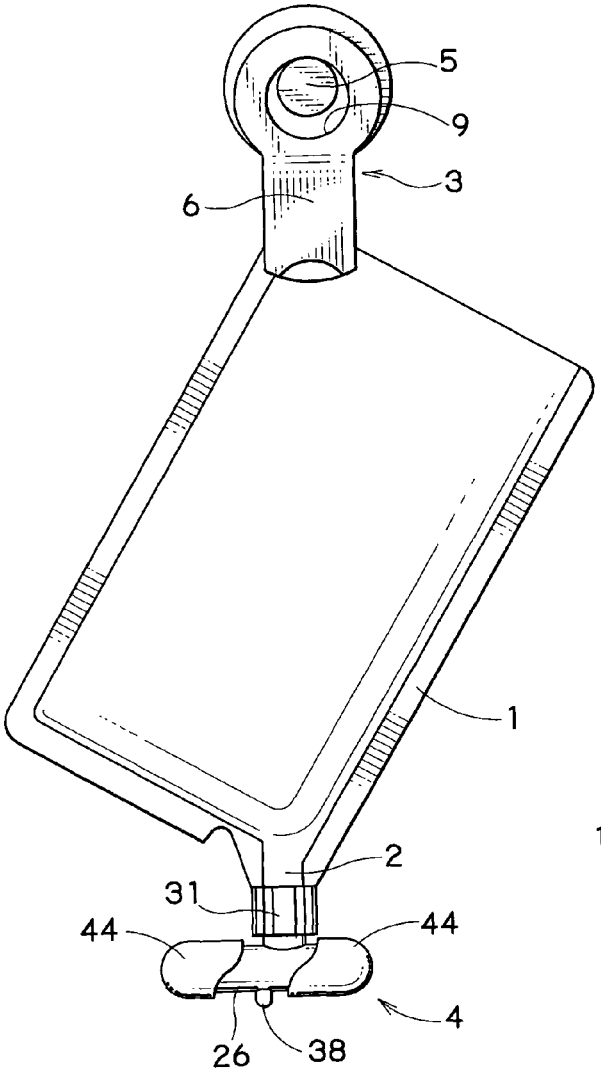
FIG. 1 is a perspective view showing an embodiment of an apparatus for extracting the contents of a refill pouch according to the present invention, in which a pouch is held by and hung from a gripping device.
Figure 2:
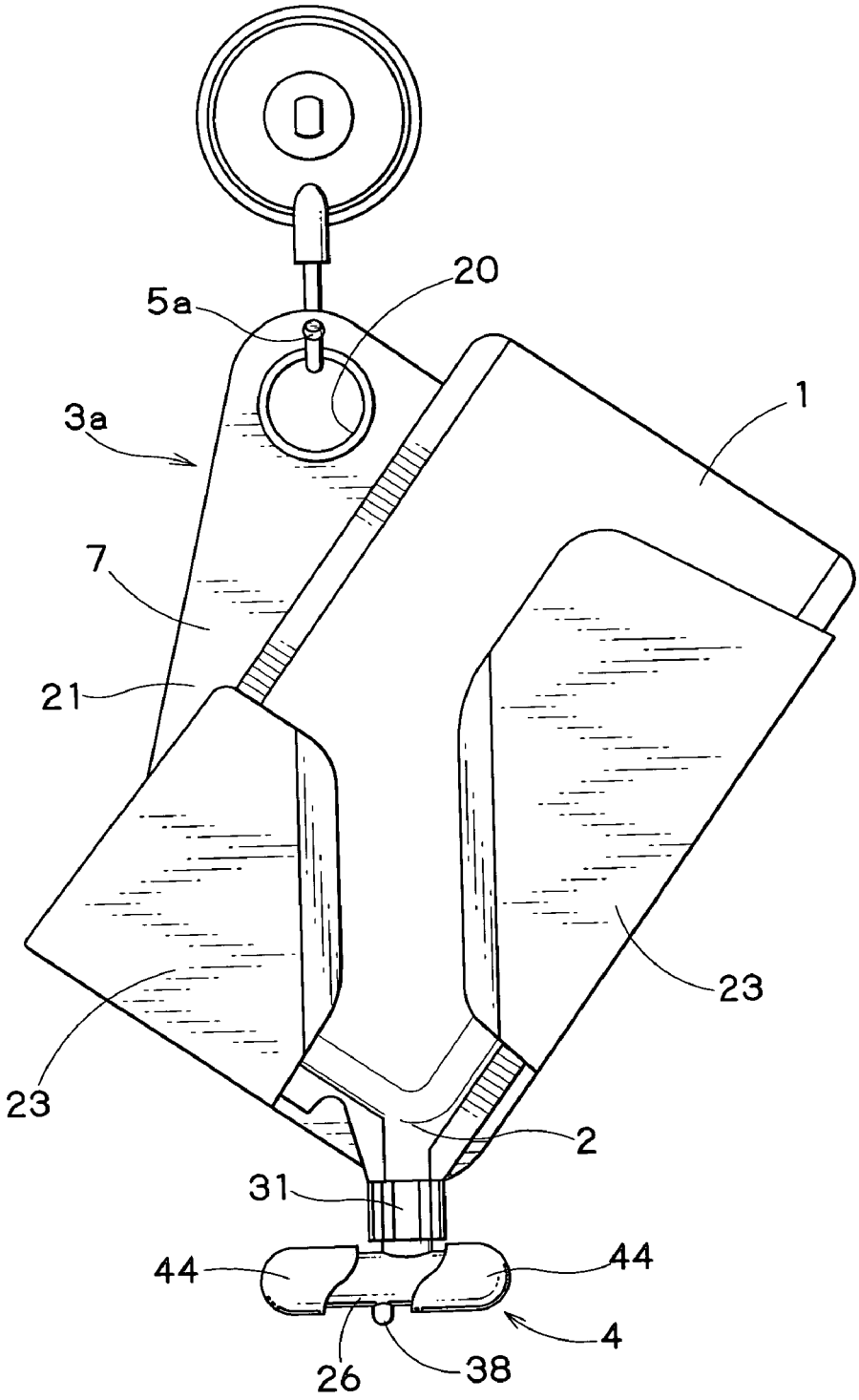
FIG. 2 is a perspective view showing another embodiment of an apparatus for extracting the contents of a refill pouch according to the present invention, in which a pouch is contained in a housing case.

FIGS. 1 and 2 show two embodiments of the present invention, and in each embodiment the apparatus comprises a holding member 3 (FIG. 1) or 3*a* (FIG. 2) for holding a refill pouch 1 with its extraction port (discharge tap) 2 directed downward, and a pump 4 attachable to the extraction port 2 of the pouch 1. In these embodiments, the refill pouch is of the type having a screw cap (not shown) that is threadedly attached to the extraction port so that when the cap is removed, the pump 4 can be threadedly attached to the extraction port 2.

In the embodiment shown in FIG. 1, the holding member 3 comprises a gripping device 6 for releasably gripping the bottom of the pouch 1 (the upper portion in the drawing) and by which the pouch can be hung on a hook 5 or the like fixed to a wall by a suction cup, etc., so that the pouch hangs upside down. In the embodiment shown in FIG. 2, the holding member 3*a* comprises a housing case 7 for holding the pouch 1 therein in an upside down state and which can be hung on a hook 5*a* or the like fixed to a wall by a suction cup, etc. Since the refill pouch 1, such as a shampoo liquid package, has a smooth surface and its weight is relatively high, it is preferred to use a gripping device having a large gripping force. Instead of the hook, a rod-like hanger (not shown) may be provided to hang the holding member therefrom.

Figure 3:
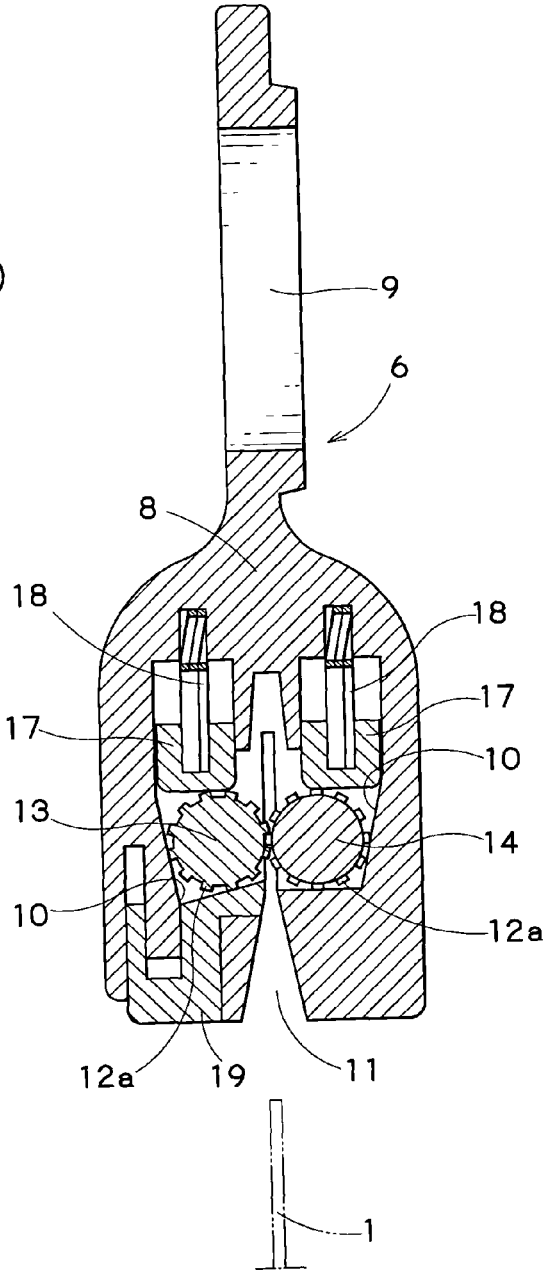
FIG. 3 is a cross-sectional view of the gripping device.
Figure 4:
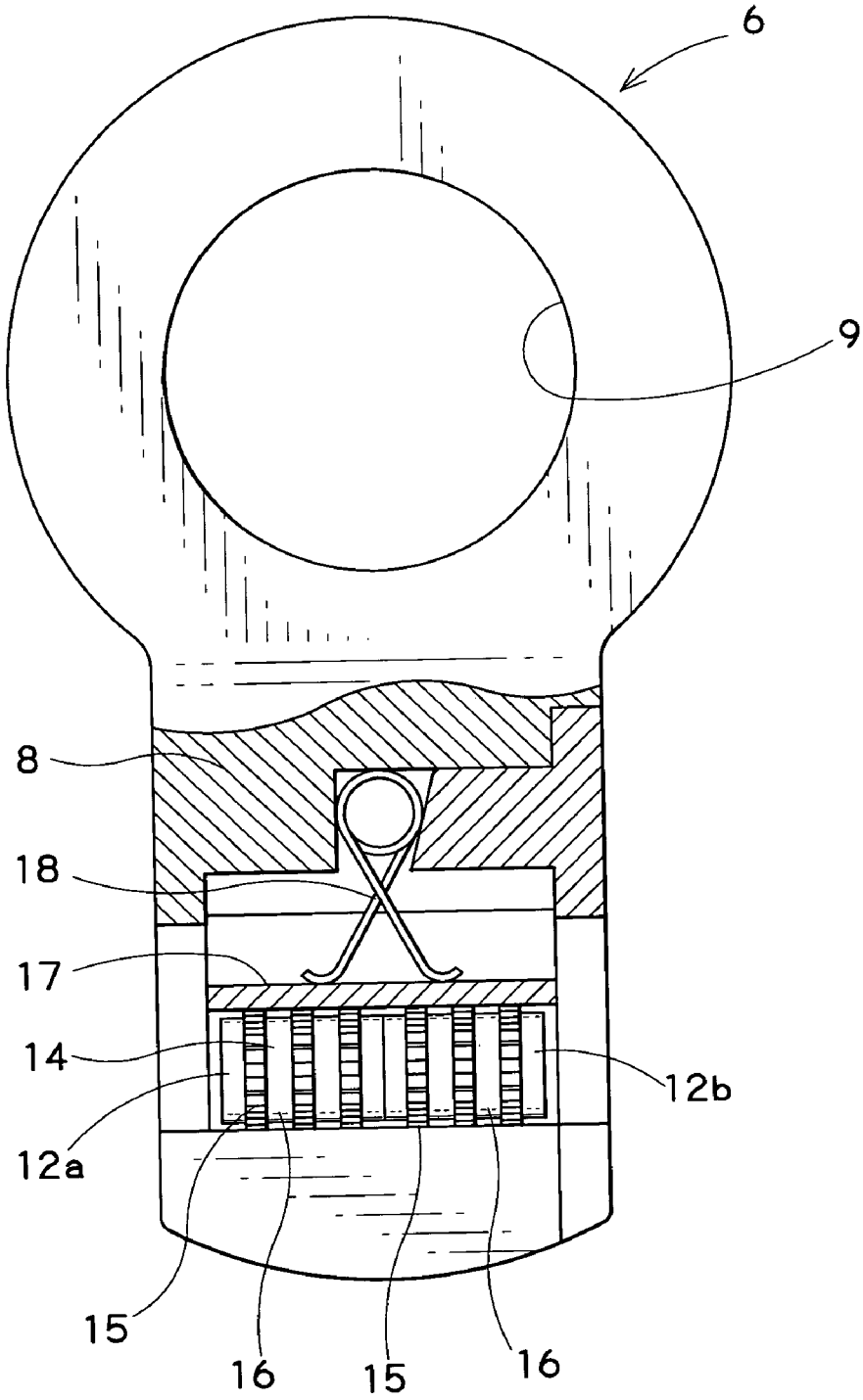
FIG. 4 is a cross-sectional view in the direction along a group of rollers of the gripping device.

FIGS. 3 and 4 show the gripping device 6 preferably used in the present invention. In the gripping device 6, the upper part of a gripping device body 8 is provided with a hook hole 9 for hooking it on the hook 5. If the gripping device 6 is hung on a rod-like hunger (not shown), the gripping device body 8 may be provided with a hanging section of a hook-like shape (not shown). On the inner surface of the gripping device body 8, slanted or inclined faces 10,10 are formed opposite to each other, and an insertion port 11 is formed which opens in the lower and side directions of the gripping device body 8. Two parallel groups 13,14 of rollers 12*a*, 12*b* are disposed in the gripping device body 8 adjacent to the insertion port 11, preferably in rotatable contact with the slanted faces 10,10, for gripping the pouch 1. In the drawing, roller groups 13,14, each having two rollers 12*a*, 12*b* aligned in a row, are positioned to face each other. When the pouch 1 is inserted between the roller groups 13,14, the rollers are pushed by the pouch and moved inwardly of the insertion port 11 (upwardly in FIG. 3) along the slanted faces 10,10.

On the surface of each of the rollers 12*a*, 12*b*, an engaging surface is formed so as to frictionally grip the pouch 1. As the engaging surface, in the example shown in the drawing, a plurality of projections 15 and a plurality of grooves 16 extending in the circumferential direction of the rollers are alternately formed along the lengths of the rollers, and the roller groups 13,14 are arranged in such a positional relationship that the projections 15 of one roller engage with the grooves 16 of the opposite roller. Accordingly, even if the pouch 1 inserted between the roller groups 13, 14 through the insertion port 11 is shifted to the left or right, the plurality of rollers 12*a*, 12*b* constituting the roller groups 13,14 can move individually while gripping the pouch, by which the gripping action is effectively distributed so that a sufficient gripping action is maintained. By such a construction, it is possible to securely hold a refill pouch, like a shampoo liquid package, which is heavy and has a smooth surface.

Further, receiving sections 17,17 are slidably disposed in the gripping device body 8 and contact upper faces of the roller groups 13,14, respectively, and springs 18,18 press the receiving sections 17,17 into pressure contact with the roller groups 13,14 to urge the roller groups toward the inlet of the insertion port 11 (downwardly in FIG. 3). Due to the opposed slanted or inclined faces 10,10, the downward movement of the roller groups 13,14 urges the roller groups closer together thereby increasing the gripping action on the pouch 1. A slide switch 19 is provided on the gripping device body 8 and is manually movable up and down so that the roller group 13 can be displaced inwardly (upwardly in FIG. 3). When the roller group 13 is moved upwardly by operating the slide switch 19, the gripping action is released and an empty pouch can easily be taken out.

Figure 5:
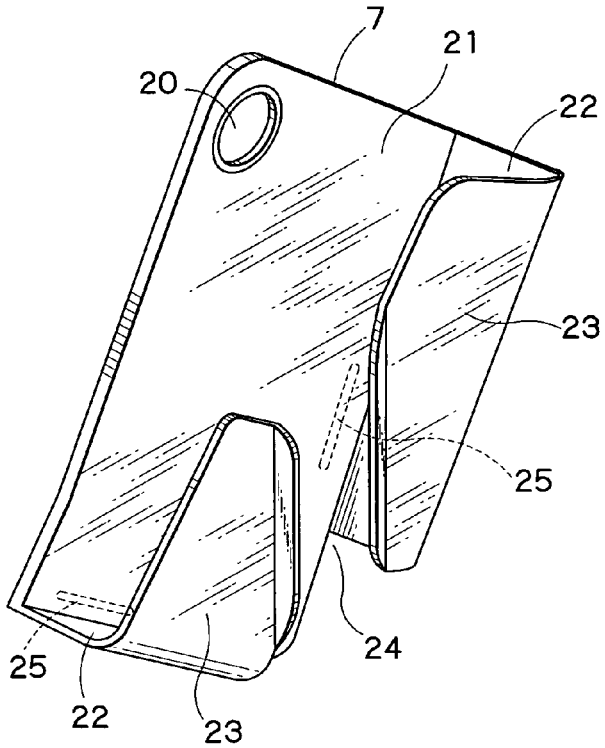
FIG. 5 is a perspective view of the housing case.

FIG. 5 illustrates the housing case 7 used in the embodiment shown in FIG. 2. The housing case 7 comprises a plate-like case body 21 having a hook hole 20, and a front faceplate 23 connected to the case body 21 by a side plate 22. The front faceplate 23 is spaced from the case body 21 to define a space therebetween for receiving and holding a pouch 1. The front faceplate 23 is provided with a gap 24 in the center region thereof so that the pouch 1 can be held in the space between the case body 21 and the front faceplate 23 with the extraction port 2 of the pouch projecting downward from the gap 24, as shown in FIG. 2. Projection strips 25 or other suitable spacers are attached at appropriate locations to the rear face of the case body 21 for contacting with the wall face when the housing case 7 is hooked on a hook 5*a* to prevent the case body 21 from wobbling or shaking.

Figure 7:
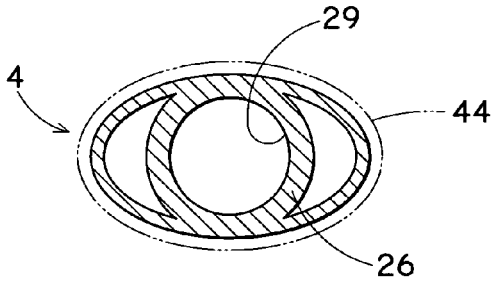
FIG. 7 is a cross-sectional view of a pump body of the pump shown in FIG. 6 as viewed from the side.
Figure 6:
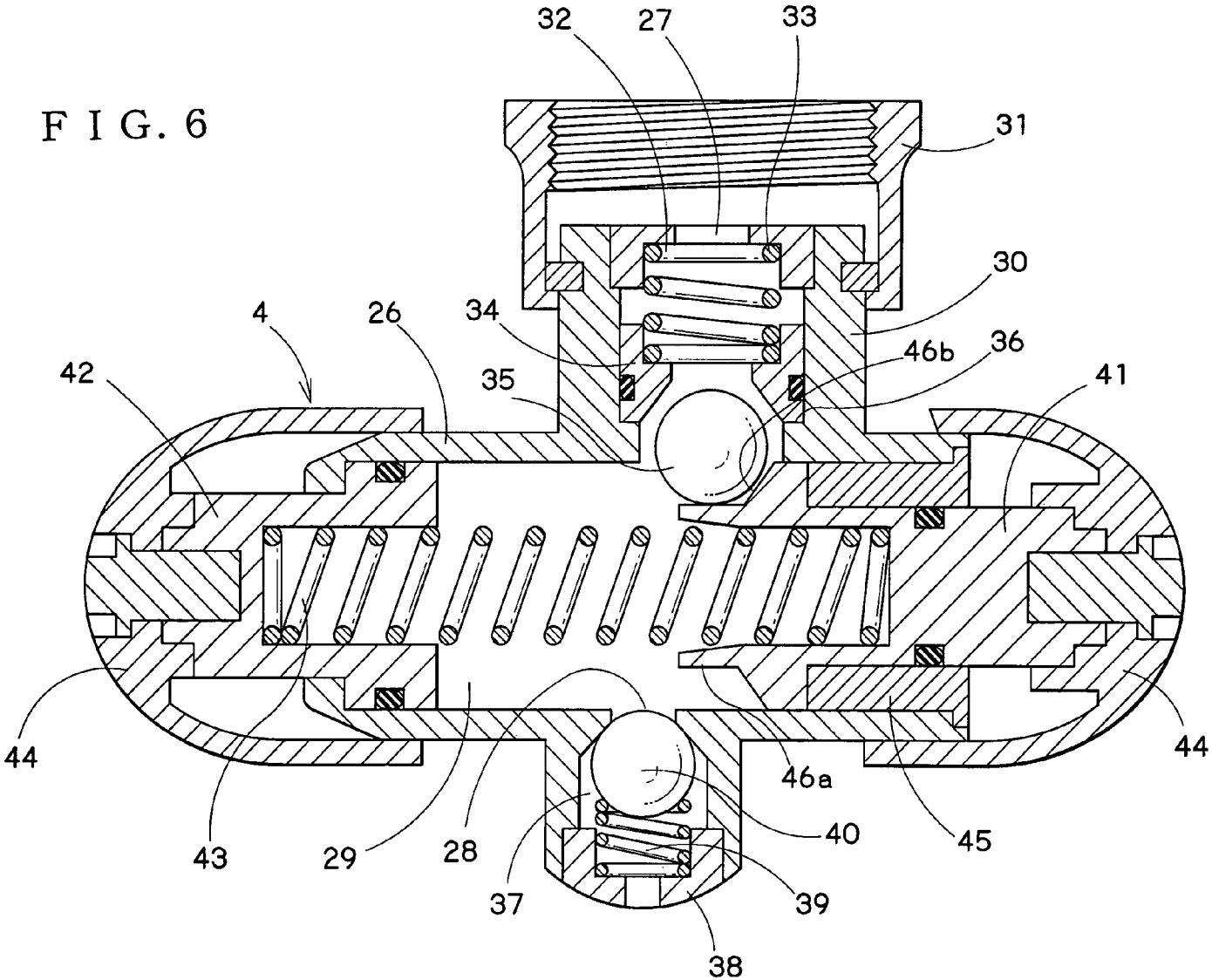
FIG. 6 is a cross-sectional view showing an example of a pump.

FIGS. 6 and 7 show an example of the pump 4 used in the embodiments illustrated in FIGS. 1 and 2. The pump 4 has a pump body 26 of a substantially cylindrical shape, and a housing space 29 having an inlet opening 27 and an outlet opening 28 are formed in the pump body 26. As shown in FIG. 7, the housing space 29 preferably has a circular shape in cross section, and the outer periphery of the pump body 26 is preferably formed in an oval shape, though other shapes may be used. Around the inlet opening 27 is formed an inlet cylinder 30, and a joint cap 31 is disposed around and attached to the inlet cylinder 30. The joint cap 31 has an internal thread portion which threadedly attaches to the thread portion formed at the discharge tap of the extraction port 2 of the pouch 1. At the inlet cylinder 30, an inlet-side valve 32 is provided which can open and shut (close) the flow path connected to the inlet opening 27 to control extraction of the contents, such as a shampoo liquid, from the pouch 1.

The inlet-side valve 32 is constituted, for example, by a ball valve having a valve seat 34 which is urged downwardly toward the housing space 29 by a spring 33, and a ball 35 which is disposed in the housing space side in such a manner that it is movable toward and away from the valve seat 34. When the valve seat 34 abuts against a stepped portion 36 of the inlet cylinder 30 as shown in FIG. 6, a gap is formed between the ball 35 and the valve seat 34 and the flow path communicating with the inlet opening 27 is in an open condition. When the housing space 29 is pressurized to raise the ball 35, the ball 35 is brought into close contact with the valve seat 34 to close the inlet-side valve 32 and the flow path communicating with the inlet opening 27 is closed.

The outlet opening 28 is formed at a substantially intermediate portion of the pump body 26, and an outlet-side valve 37 is provided for opening and closing the outlet opening 28 to control discharge of the pouch contents contained in the housing space 29 through a nozzle 38 which communicates with the outlet-side valve 37. The outlet-side valve 37 is constituted by a ball valve having a ball 40 which is urged upwardly by a spring 39 towards a valve seat that surrounds the outlet opening 28 to normally close the outlet opening 28. When the contents within the housing space 29 are pressurized above a certain level, the pressure exerted on the ball 40 overcomes the spring pressure exerted by the spring 39 thereby moving the ball 40 downwardly away from the valve seat to open the outlet opening 28.

Spindles 41,42 are movably disposed in spaced-apart relation at opposite ends of the pump body 26 and are movable sidewise in the axial direction of the pump body toward and away from one another. A coil spring 43 is interposed between the spindles 41,42 and urges the spindles apart, as shown in FIG. 6. When the spindles 41,42 are moved toward each other, the volume of the housing space 29 diminishes thereby increasing the pressure of the contents within the housing space so that the contents can be extracted through the outlet-side valve 37. Though in this embodiment a single a spring 43 is used to urge the spindles 41,42 apart from each other, in an alternative arrangement two springs (not shown) may be disposed at the outer portion of the pump body 26 to individually urge the spindles apart. An end cap 44 is attached to the outer end portion of each spindle, and the caps 44,44 are fitted to the outer periphery of the pump body 26. The spindle 41 is slidably inserted into a bush 45 connected to the pump body 26, and the inward end of the spindle 41 is provided with an annular projection 46*a* that supports the ball 35 of the inlet-side valve 32. The proximal end of the projection 46*a* terminates in a slanted face 46*b*. When the spindles 41,42 move axially toward each other, the slanted face 46*b* pushes the ball 35 upwardly so that the ball 35 comes in close contact with the valve seat 34 of the inlet opening 27 to close the inlet opening. At appropriate portions of the valve seat 34 and the spindles 41,42, sealing members such as O-rings are provided to ensure fluid tightness.

According to the embodiments illustrated in FIG. 1 and FIG. 2, when the caps 44,44 at both ends of the pump body 26 are manually pushed inwardly by the hands of the user, such as by squeezing the caps inwardly towards each other in a sidewise direction of the pump 4, to displace the spindles 41,42 inwardly and compress the spring 43, the ball 35 of the inlet-side valve 32 is directly pressed against the valve seat 34 and the flow path communicating with the inlet opening 27 is immediately and securely shut. When the spindles are further moved inwardly towards one another, the contents within the housing space 29 are extracted from the nozzle 38 through the outlet opening 28. When the manual pressing force applied to the spindles 41,42 is released, the restoring force of the compressed spring 43 moves the spindles outwardly and, by the vacuum suction created within the housing space 29 when the spindles return to their original positions, the inlet opening 27 is opened and the outlet opening 28 is closed, whereby more of the contents within the pouch 1 can be introduced into the housing space 29. In such a manner, the contents, such as shampoo liquid, in the pouch 1 can completely be extracted. The pressing force when the spindles 41, 42 are operated works only in the axial direction of the pump body 26, and does not work on the holding member 3 or the wall to which the holding member 3 is attached, whereby there is no risk of detachment of the pouch.

Figure 8:
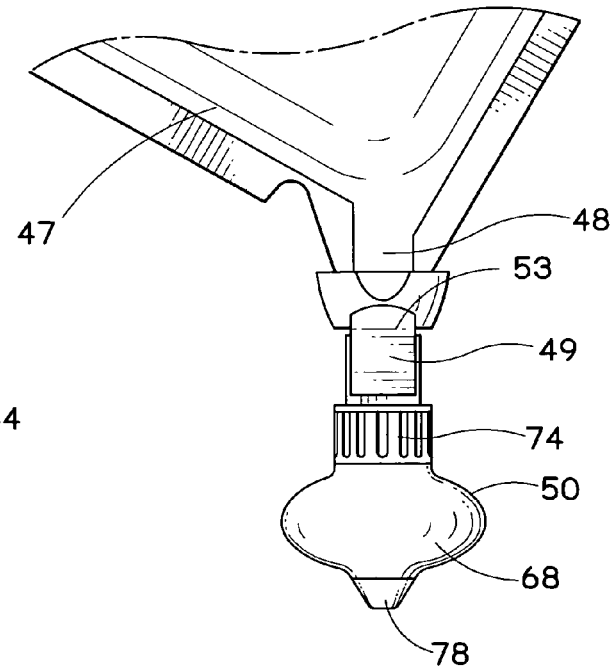
FIG. 8 is partial perspective view showing another embodiment of an apparatus for extracting the contents of a refill pouch according to the present invention.

FIG. 8 shows an embodiment of the apparatus of the present invention for use with a refill pouch 47 of the type having an extraction port (tearable spout) 48 which is opened by cutting or otherwise severing a corner of the pouch. The apparatus comprises an insertion-securing device 49 that is insertable into the opened extraction port 48 and securable to the pouch 47, and a pump 50 that is connectable to the insertion-securing device 49 for extracting the contents from the pouch.

Figure 9:
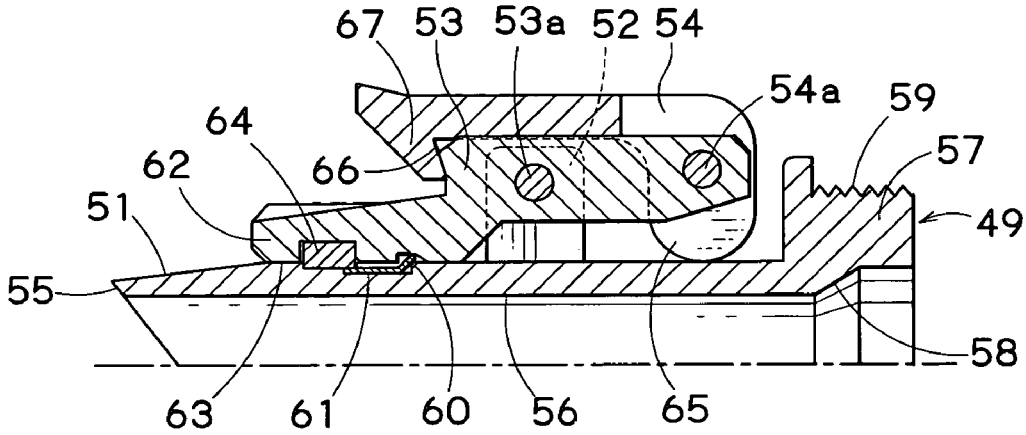
FIG. 9 is an explanatory partially cutaway view showing an insertion-securing device in a state in which a clamp section is attached under pressure.
Figure 10:
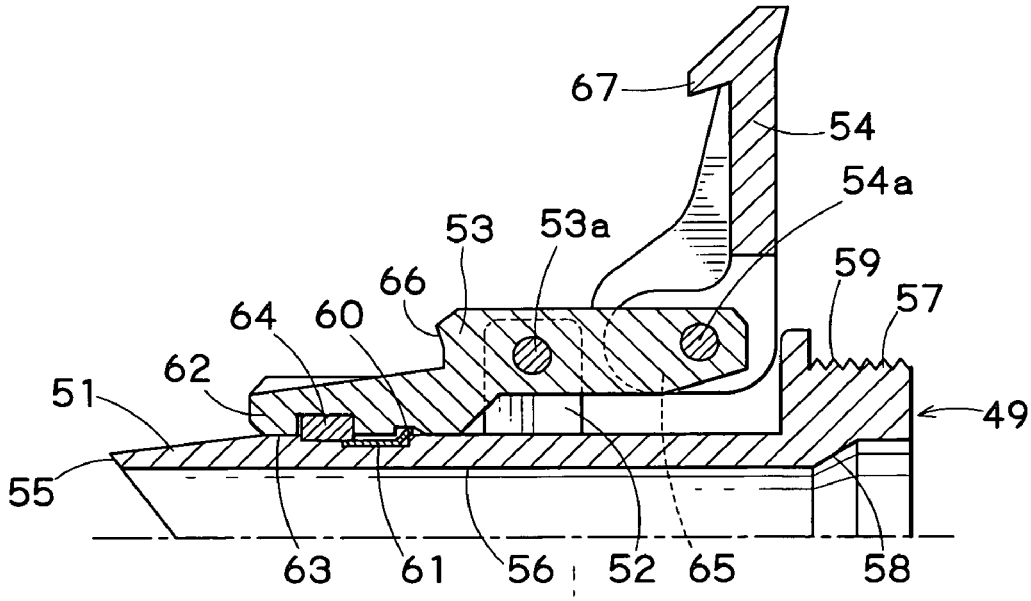
FIG. 10 is an explanatory partially cutaway view showing the insertion-securing device in a state in which the clamp section is released.
Figure 19:
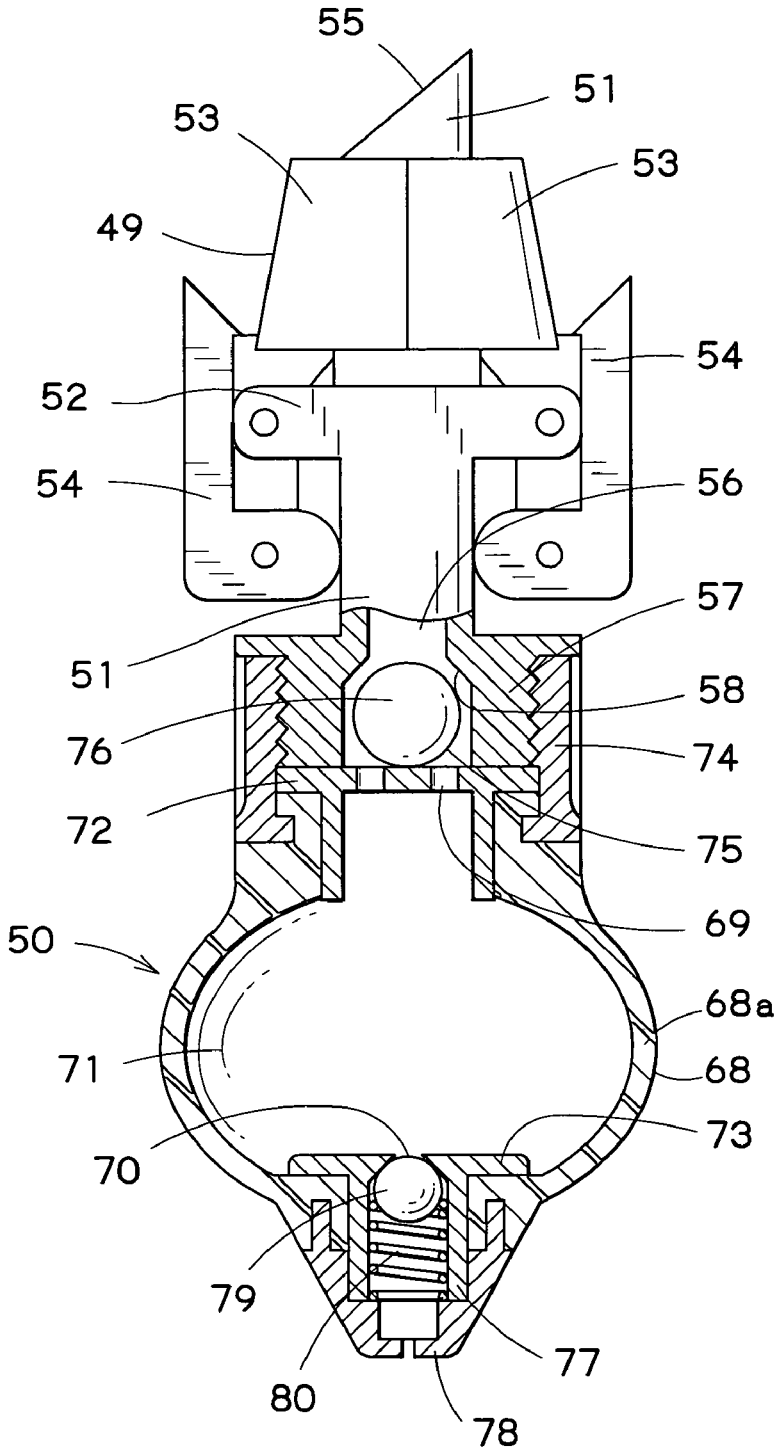
FIG. 19 is a cross-sectional view of the pump shown in FIG. 18 as viewed from the side.

The insertion-securing device 49 is shown in FIGS. 9-10 and comprises an insertion cylinder 51, a pair of clamp sections 53 pivotally mounted on pins 53*a* on struts 52 which protrude oppositely on the outer periphery of the insertion cylinder 51, and a lever 54 pivotally mounted on pins 54*a* on each clamp section 53 so as to operate the clamp section 53 (FIG. 19).

Figure 11A:
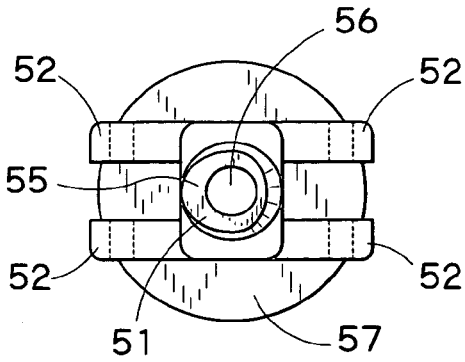
Figure 11B:
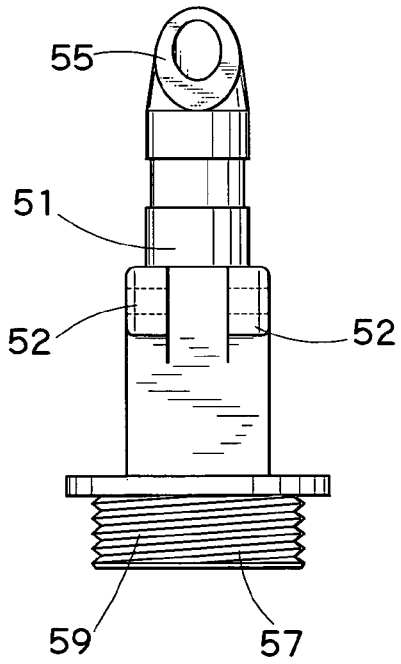
Figure 11C:
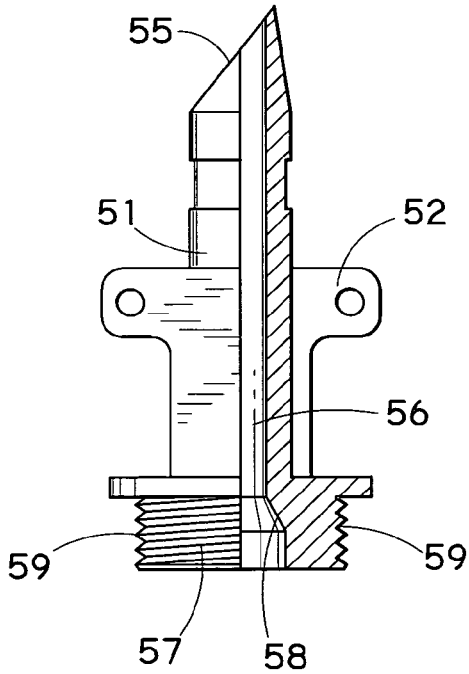
Figure 12A:
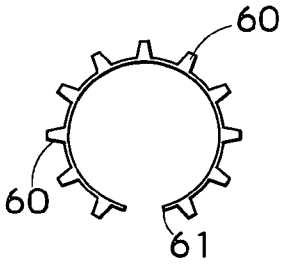
Figure 12B:
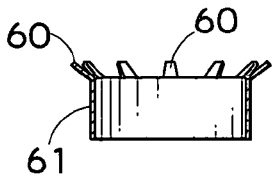

The insertion cylinder 51 is illustrated in more detail in FIGS. 11A-11C and has a forward end 55 formed in a slanted shape so that the insertion cylinder 51 can easily be inserted into the extraction port 48. A cone-shaped opening 58 is formed at a connecting portion 57 at the rear end of the insertion cylinder 51 and communicates with an internal flow path 56, and as described below, a ball of a ball valve is housed in the cone-shaped opening 58 (FIG. 19). An external screw thread 59 is formed on the outer face of the connecting portion 57 (FIG. 11B and FIG. 11C), and an engaging section 61 is provided on the outer face on the forward end side of the insertion cylinder 51. The engaging section 61 has saw-toothed engaging projections 60 made of a metal material (FIG. 12A and FIG. 12B).

Figure 13A:
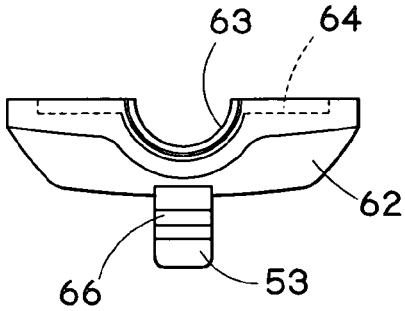
Figure 14A:
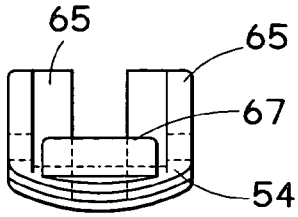
Figure 13B:
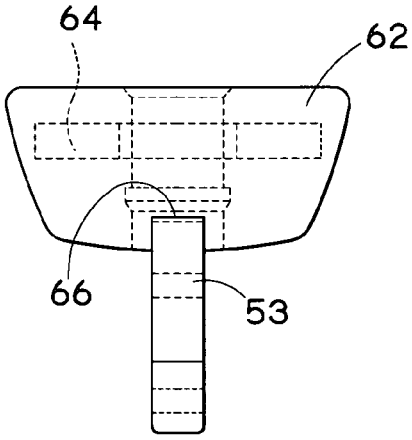
Figure 14B:
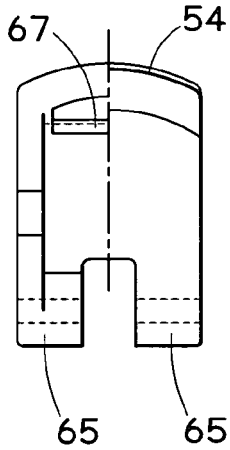
Figure 13C:
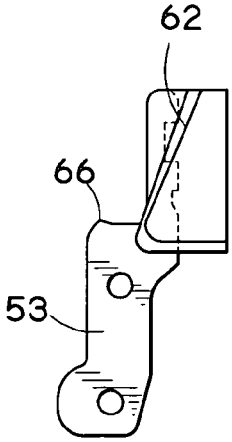
Figure 14C:
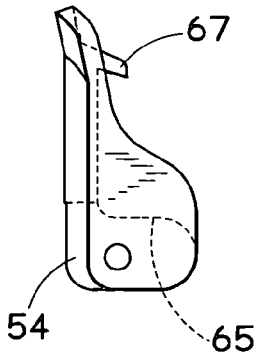

With reference to FIGS. 13A to 13C, each clamp section 53 has a wing plate portion 62, and at substantially the central part of the wing plate portion 62, a concave part 63 is formed which has a shape that matches (complements) the outer face of the insertion cylinder 51. An elastic member 64 made of, for example, a rubber material, is provided on the inner surface of the concave part 63. As shown in FIGS. 14A-14C, at the rear end of the lever 54, a cam part 65 is formed which abuts against the circumferential face of the insertion cylinder 51 when the lever 54 is pivoted inwardly (turned down) in contact with the insertion cylinder 51 (FIG. 9). At the forward end of the lever 54, a claw section 67 is formed which is engagable with a hook part 66 of the clamp section 53 (FIG. 9).

In a state in which the levers 54 are pivoted outwardly (raised) (FIG. 10), the insertion cylinder 51 is inserted into the extraction port 48 which has previously been opened by removing a corner of the pouch 47, for example, by cutting off the corner, and the insertion cylinder 51 is inserted sufficiently into the pouch body to enable extraction of the pouch contents. Afterwards, when the levers 54 are pivoted inwardly (turned down), the forward end of each clamp section 53 is pressed tightly against the outer face of the insertion cylinder 51 by the action of the cam part 65 (FIG. 9), and the wing plate portion 62 of the clamp section 53 fixes the pouch under pressure, and the engaging section 61 and the elastic member 64 act to prevent slippage. By this operation, the insertion-securing device 49 tightly closes the extraction port 48 of the pouch 47 and is securely attached to the pouch, whereby there is no risk of leakage of the contents through the extraction port 48.

Figure 15:
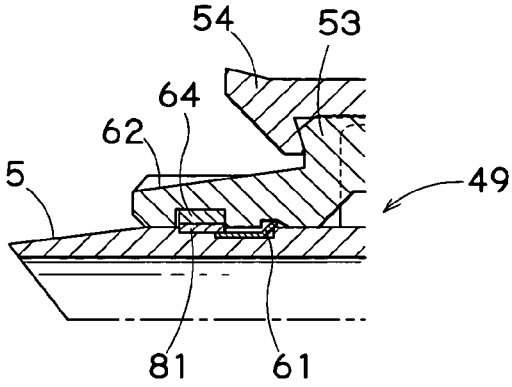
FIG. 15 is a cross-sectional view showing an example of an insertion cylinder portion.
Figure 16:
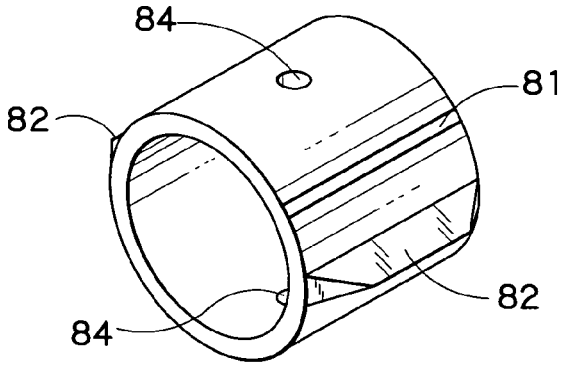
FIG. 16 is a perspective view of a contact member.

In some cases, depending on the material of the refill pouch, when the extraction port of the pouch is pinched by the clamp sections 53,53, the sheet constituting the pouch does not bend in a circular shape along the outer face of the insertion cylinder, and a slight gap is formed between the inner surfaces at the fused portion of the sheet, resulting in the risk of leakage of the pouch contents. In such a case, a sealing member 81 made of an elastic material and formed in a cylindrical shape may be provided on the outer periphery of the insertion cylinder 51 of the insertion-securing device 49 as shown in FIG. 15. The sealing member 81 has outwardly protruding ears 82,82 of a substantially triangular shape in section at both sides, and fitting holes 84,84 into which projections 83,83 formed on the insertion cylinder 51 are to be fitted for positioning the sealing member on the insertion cylinder, as shown in FIG. 16.

Figure 17:
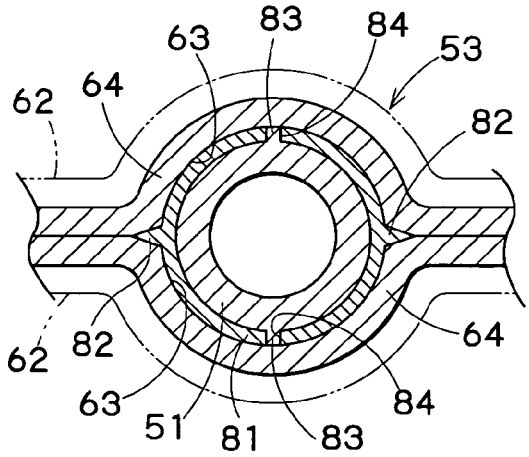
FIG. 17 is an explanatory view in such a state that attachment under pressure is made by a clamp section.

By this operation, as shown in FIG. 17, when the outer face of the insertion cylinder 51 which has been inserted into the extraction port 48 of the pouch 47 is clamped or pinched by the clamp sections 53,53, most of the clamped part of the pouch is pinched by the concave parts 63 of the clamp sections, and the ears 82,82 projecting sidewise enter the gaps between the sheets of the pouch along the insertion cylinder 51. The outer faces of the ears are thus fixed under pressure by the wing plate portions 62,62 of the clamp sections 53,53, and the gaps between the sheets of the pouch are thereby closed, whereby leakage of the contents can be prevented.

Figure 18:
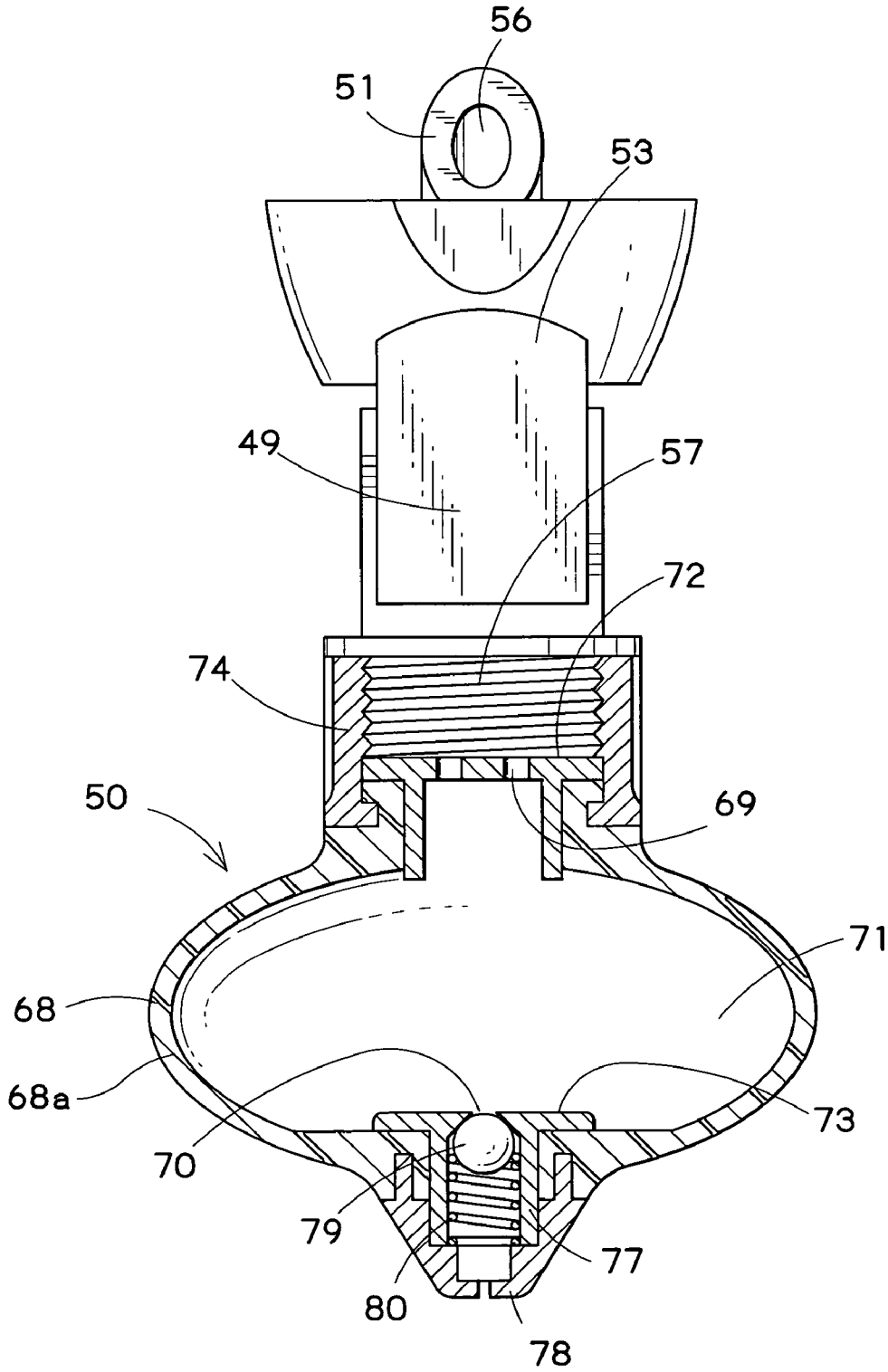
FIG. 18 is a cross-sectional view showing another example of the pump.

FIG. 18 and FIG. 19 show an example of the pump 50 to be connected to the insertion-securing device 49. The pump 50 has a pump body 68 having a squeezable wall portion 68*a* comprised of resiliently compressible, restorable and flexible material such as silicone rubber, and the pump body is provided with a substantially spherical housing space 71 having an inlet opening 69 and an outlet opening 70. If a transparent material is used as the flexible material for the wall portion 68*a* of the pump body 68, it is possible to see the inside of the housing space 71 through the wall of the pump body. The entire pump body 68 may, of course, be formed of the same flexible material, as illustrated in this example. At the inlet opening 69 and the outlet opening 70 are provided inner rings 72 and 73 formed of a metal material or a hard plastic material, and at the outer periphery of the inner ring 72 of the inlet opening 69, is provided a screw cap 74 which is threadedly engaged with the screw thread 59 of the insertion-securing device 49. The inlet opening 69 is provided with an inlet-side valve 75 for introducing the pouch contents into the housing space 71 from the pouch 47. In the example shown in FIG. 19, the inlet-side valve 75 is a ball valve having a ball 76 disposed inside the connecting portion 57 of the insertion-securing device 49.

When the ball 76 moves upwardly in FIG. 19 into close contact with the cone-shaped opening 58 of the insertion cylinder 51, the cone-shaped opening 58 and the flow path 56 are closed. When the ball 76 moves downwardly, the cone-shaped opening 58 and the flow path 56 are opened and the contents in the pouch 47 flow into the housing space 71 through the inlet opening 69.

At the outlet opening 70, an outlet-side valve 77 is provided for opening and closing the outlet opening so that the pouch contents contained in the housing space 71 will be discharged. A nozzle 78 which communicates with an outlet-side valve 77 is formed at the lower end of the pump body. The outlet-side valve 77 in this example is a ball valve having a ball 79 that is urged upwardly by a spring 80 towards the outlet opening 70 to normally close the outlet opening.

In the above structure, when the pump body 68 is manually grasped and squeezed or compressed in the sidewise direction, the housing space 71 is pressurized, the ball 76 of the inlet-side valve 75 is raised to shut the flow path 56 of the insertion-securing device 49, and the pouch contents contained in the housing space 71 push the ball 79 of the outlet-side valve 77 downwardly away from the outlet opening 70 and flow out through the nozzle 78. When the manual compression of the pump body 68 is released, the resiliently compressed pump body 68 expands to its original state, the ball 79 of the outlet-side valve 77 is urged upwardly by the spring 80 and shuts the outlet opening 70, and the ball 76 of the inlet-side valve 75 is drawn down by the vacuum suction created within the housing space 71 by the expanding pump body 68 to open the flow path 56, whereby the contents in the pouch 47 are suctioned into the housing space 71 through the inlet opening 69. In this manner, the contents in the pouch, such as shampoo liquid, can be completely extracted. The pressing force when the pump body 68 is manually grasped and compressed acts on the pump body only, and not on the holding member or the wall to which the holding member is attached, whereby there is no risk of detachment of the pouch 47. In the above embodiments, ball valves are used as the pump valves, but other appropriate valves may be used.

Figure 20:
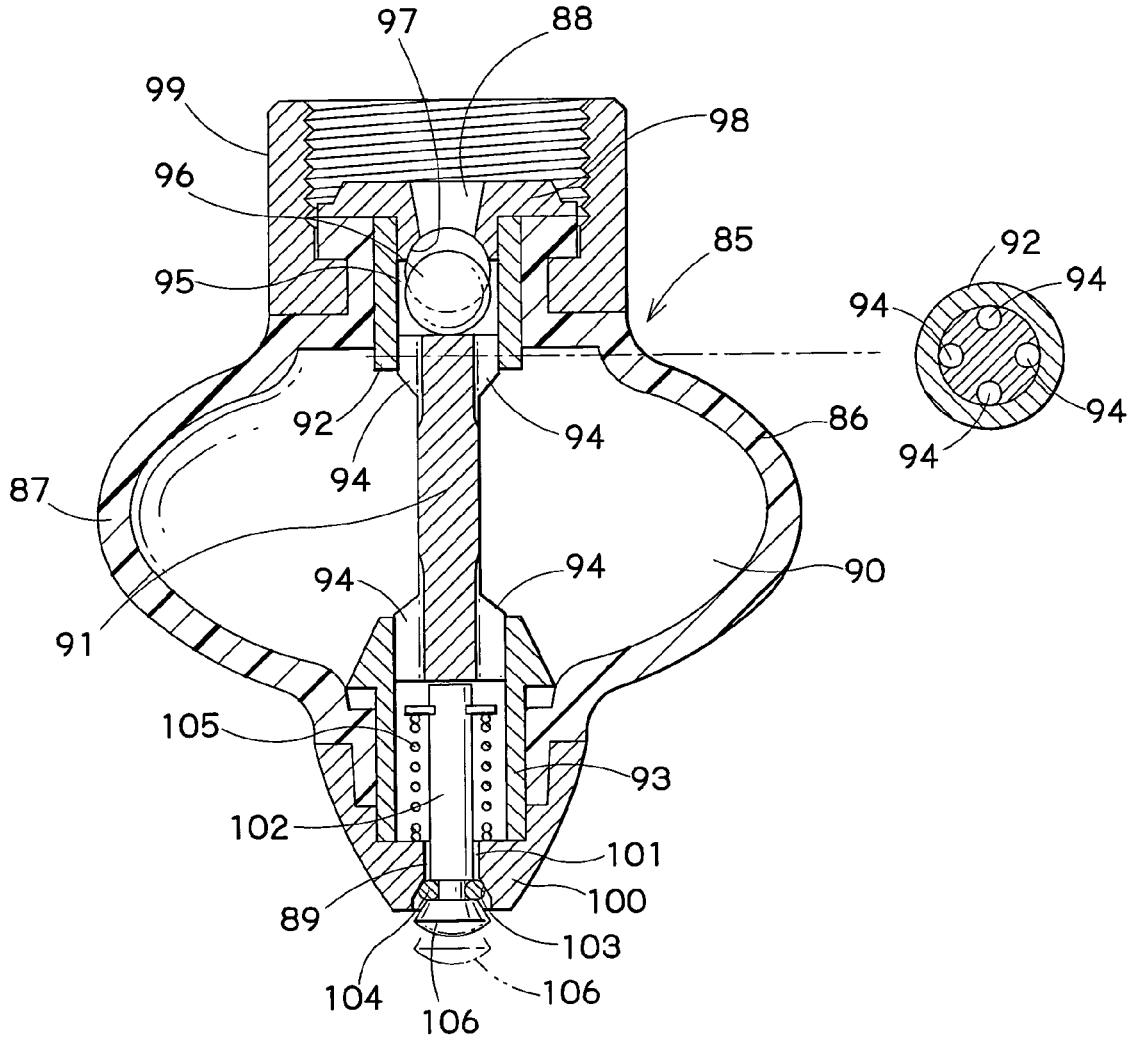
FIG. 20 is a cross-sectional view showing another example of a pump.
Figure 21:
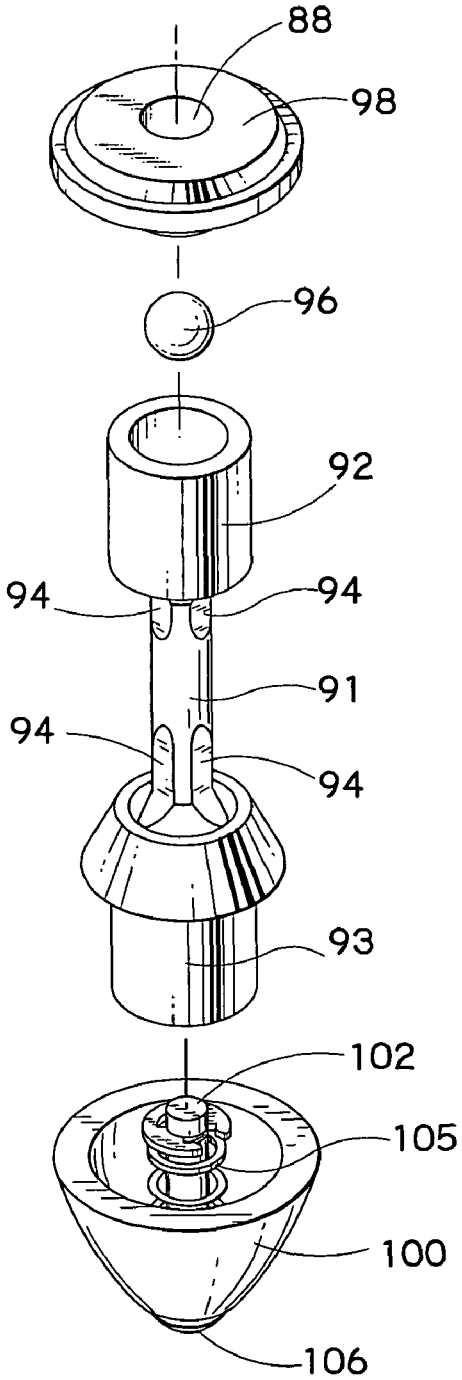
FIG. 21 is an exploded perspective view of a part of the pump shown in FIG. 20.

FIG. 20 and FIG. 21 show an example of a pump 85 that uses another type of valve other than a ball valve. In this example, the pump 85 uses a valve mounted on a valve stem as the outlet-side valve. In FIG. 20, a wall portion 87 of a pump body 86 is constituted by a resiliently compressible, restorable and flexible material such as silicone rubber as used in the examples shown in FIG. 18 and FIG. 19, and the wall portion 87 has a convex shape that bulges outwardly in the sidewise direction. The pump body 86 has a housing space 90 having an inlet opening 88 and an outlet opening 89. A support shaft 91 is inserted into the housing space 90 and has at opposite end portions thereof tubular connection portions 92,93 that connect the support shaft 91 to the pump body 86. More particularly, the support shaft 91 has an upper connection portion in the form of a cylindrical portion 92 and a lower connection portion in the form of a cylindrical portion 93, and a series of through-holes 94 are formed in both the upper cylindrical portion 92 and the lower cylindrical portion 93. Within the upper cylindrical portion 92, a ball 96 constituting a ball valve of an inlet-side valve 95 is housed, and the ball 96 is movable into and out of engagement with a valve seat 97 of the inlet opening 88. A screw cap 99 having an internal thread is fitted to the pump body 86, and a plate 98 forming the valve seat 97 is fixed to the upper end of the upper cylindrical portion 92 by ultrasonic welding.

The lower cylindrical portion 93 protrudes downward from the pump body 86, and a nozzle 100 is fitted to the forward end of the lower cylindrical portion 93 by ultrasonic welding. Within the nozzle 100, a valve stem 102 of an outlet-side valve 101 is housed. The valve stem 102 extends downwardly through the outlet opening 89 and has a valve element 104 placed opposite to a valve seat 103 formed at the outlet opening 89, and the valve stem 102 is urged by a spring 105 in such a direction that the valve element 104 is pressed against the valve seat 103. The valve element 104 has an O-ring as shown in FIG. 20. At the forward end of the valve stem 102 that protrudes from the nozzle 100, a small knob 106 is formed so that the valve stem can be grasped and pulled downwardly.

By the above structure, the pump 85 shown in FIG. 20 is connected to the refill pouch by threadedly attaching the screw cap 99 to a screw thread formed at the extraction port (discharge tap) or a screw thread of the above insertion-securing device. When the pump body 86 is manually gripped and squeezed or contracted in the sidewise direction, the inlet-side valve 95 is closed by the increased pressure of the pouch contents contained in the housing space 90, and the valve element 104 of the outlet-side valve 101 moves downward against the spring 105, whereby the pouch contents contained in the housing space 90 can be extracted through the nozzle 100. When the contraction of the pump body 86 is released, the pump body expands back to its original state. By suction vacuum created within the housing space 90 by the expanding pump body 86, the inlet-side valve 95 is opened, the contents in the pouch enter the housing space 90 through the inlet-side valve 95, the valve stem 102 is raised by the force exerted thereon by the spring 105, and the valve element 104 engages with the valve seat 103 to shut the outlet opening 89.

If the contents solidify at the outlet opening 89 due to non-use for a long period, the outlet opening is blocked by the solidified product, movement of the valve becomes uncertain, and the contents might not be extracted. If such a situation occurs, by manually pulling the knob 106 formed at the outer side of the nozzle 100, the valve stem 102 is moved and the solidified product can be eliminated from the outlet opening 89, and then the contents can be extracted by contracting the pump body as mentioned above.

While the invention has been particularly shown and described with reference to preferred embodiments and examples thereof, it will be understood by those skilled in the art that various changes and modifications in form and details may be made thereto without departing from the spirit and scope of the invention as defined in the appended claims.

What is claimed is:

1. An apparatus for extracting contents from a refill pouch, comprising: a holding member for holding a refill pouch with its extraction port facing downward; and a pump attached to the extraction port of the pouch, the pump comprising a pump body defining a housing space having an inlet opening and an outlet opening, an inlet-side valve which communicates with the extraction port and acts to open and close the inlet opening so that the contents can be introduced into the housing space from the pouch, an outlet-side valve which acts to open and close the outlet opening so that the contents in the housing space can be discharged, a nozzle that communicates with the outlet-side valve for discharging the contents contained in the housing space when the outlet-side valve is open, a support shaft inserted into the housing space and having an upper cylindrical portion and a lower cylindrical portion, the upper cylindrical portion being provided with the inlet-side valve and the lower cylindrical portion being provided with the outlet-side valve, and the pump body having a pump wall portion constituted by a resiliently compressible, restorable and flexible material so that the contents in the housing space can be extracted through the nozzle by compressing the pump wall portion thereby pressurizing the housing space, wherein the inlet-side valve comprises a ball valve having a ball on the housing space side, and the outlet-side valve comprises a valve stem having a valve element which engages with a valve seat of the outlet opening, a spring which urges the valve stem in such direction to press the valve element to the valve seat, and a knob that is connected to the valve stem and that extends outside of the nozzle to enable manual movement of the valve stem from outside the pump.

2. An apparatus for extracting contents from a refill pouch, comprising: a holding member for holding a refill pouch that has an extraction port at a bottom portion of the pouch; and a pump attachable to the extraction port of the pouch for extracting the contents from the pouch, the pump having a pump body that defines a housing space having an inlet opening and an outlet opening, an inlet-side valve that communicates with the extraction ort and that opens and closes the inlet opening so that the contents in the pouch can be introduced into the housing space, an outlet-side valve that opens and closes the outlet opening so that the contents in the housing space can be discharged through the outlet opening, a support shaft disposed in the housing space and having at each end portion thereof a connection portion that connects the support shaft to the pump body, one connection portion being provided with the inlet-side valve and the other connection portion being provided with the outlet-side valve, and the pump body having a wail portion that is made of resiliently compressible material and that is configured to be manually grasped and squeezed in a sidewise direction of the pump body to contract the pump body and pressurize the contents in the housing space to thereby discharge the contents through the outlet opening and that expands to its original shape when the squeezing is discontinued to create a vacuum suction in the housing space to suck contents from the pouch through the inlet opening into the housing space, wherein the other connection portion has a tubular shape, and the outlet-side valve comprises a valve stem movable into and out of engagement with a valve seat to close and open the outlet opening, a spring that urges the valve stem into engagement with the valve seat when the pump body is not being squeezed, the valve stem and the spring being disposed inside the other tubular connection portion, and a manually graspable knob that is connected to the valve stern and that extends outside the pump body to enable manual movement of the valve stem from outside the pump body.

* * * * *